United States Patent [19]

Kalve

[11] Patent Number: 4,769,932

[45] Date of Patent: Sep. 13, 1988

[54] WALKING DRAGLINE EXCAVATOR FRAMES WITH TORSION RESISTANT TUBULAR-WEB RAIL GIRDERS AND OTHER IMPROVEMENTS

[76] Inventor: Ernest Kalve, 6700 W. Lake Rd., Newburgh, Ind.

[21] Appl. No.: 37,201

[22] Filed: Apr. 10, 1987

[51] Int. Cl.[4] ..... E02F 3/46; E04H 12/14

[52] U.S. Cl. ..... 37/115; 212/175; 212/253; 52/646; 248/678

[58] Field of Search ..... 37/115–117; 212/167, 175, 253, 252; 308/8.1; 248/648, 678; 414/744; 52/64, 65, 646, 648

[56] References Cited

U.S. PATENT DOCUMENTS

| | | | |
|---|---|---|---|
| 1,635,689 | 7/1927 | Rauch | 212/253 X |
| 2,049,653 | 8/1936 | Ljungkull | 212/175 |
| 2,068,555 | 1/1937 | Ljungkull | 212/175 X |
| 2,408,378 | 10/1946 | Davenport et al. | 212/253 |
| 2,628,818 | 2/1953 | Graham | 52/646 |
| 3,888,357 | 6/1975 | Bauer et al. | 212/175 |
| 4,037,894 | 7/1977 | Sankey | 212/153 |
| 4,038,765 | 8/1977 | Sankey et al. | 37/116 |
| 4,231,699 | 11/1980 | Thompson | 212/253 X |
| 4,262,461 | 4/1981 | Johnson et al. | 52/646 |
| 4,329,795 | 5/1982 | Kalve | 37/116 |
| 4,371,086 | 2/1983 | Sankey et al. | 212/252 |
| 4,611,440 | 9/1986 | Kalve | 52/65 |

*Primary Examiner*—Eugene H. Eickholt

*Attorney, Agent, or Firm*—Hill, Van Santen, Steadman & Simpson

[57] ABSTRACT

A walking dragline excavator construction wherein both of the frames have rail beams and wherein at least one of the rail beams comprises a continuous series of vertical tubular rail girders disposed in mutually load sharing relation and cooperating in load sharing relation with the reinforcing grid of the associated frame structure. Certain of the web plates in the reinforcing grid are oriented in a triangular pattern with apices of the triangles anchored within the rail beam. Bottom plate stiffeners are attached to the bottom plate of the base frame and also attached to certain of the web plates in the reinforcing grid within the base frame for transmitting soil pressure directly to the grid plates. The rail structures of the frames include a rail pad secured to an edge of the associated rail beam, and reentrant corner torsional shear transfer truss members are fixedly secured to the rail pad and to the rail beam and to the associated horizontal plate of the frame for transferring torsional shear directly from the plate and the rail pad into the rail beam. Horizontal stiffeners are rigidly secured to and between the rail beam of at least the base frame and certain of the reinforcing grid web plates within the frame.

30 Claims, 4 Drawing Sheets

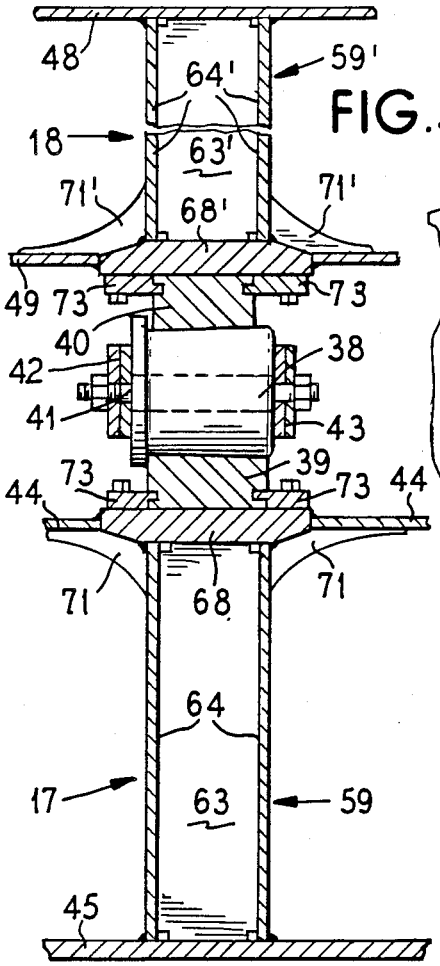
FIG.5
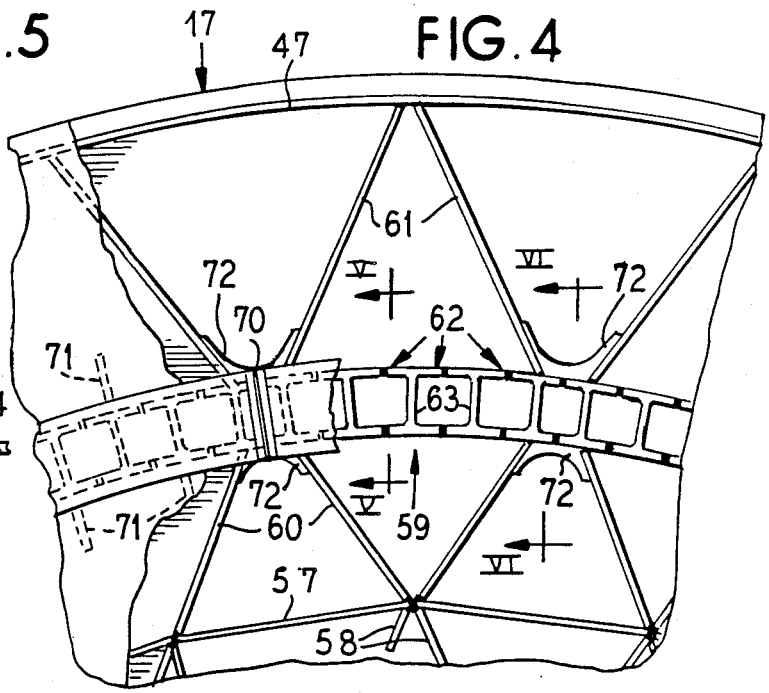
FIG.4
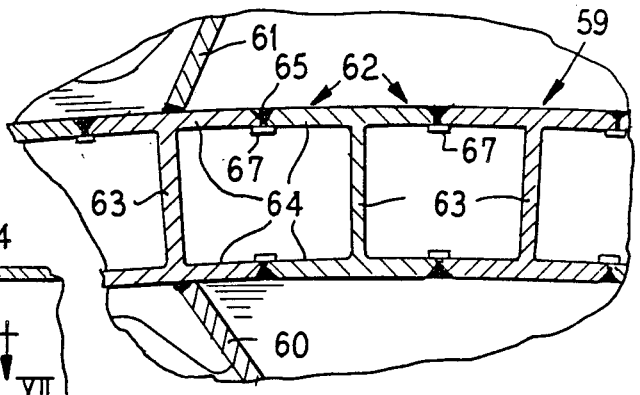
FIG.7
FIG.6
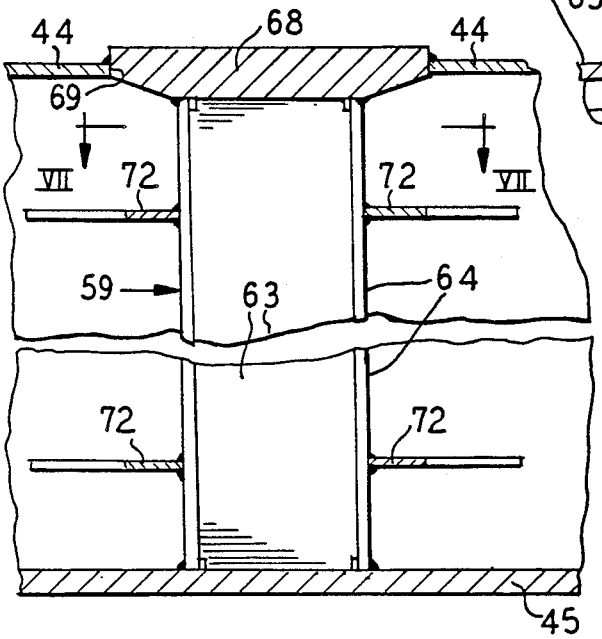

WALKING DRAGLINE EXCAVATOR FRAMES WITH TORSION RESISTANT TUBULAR-WEB RAIL GIRDERS AND OTHER IMPROVEMENTS

BACKGROUND OF THE INVENTION

The present invention relates to walking dragline excavators and is more particularly concerned with the frame structures of such excavators.

Large capacity walking dragline excavators have evolved into massive machinery structures having their own structural peculiarities. These machines are designed to handle large excavating loads, such as up to 350 cubic yards in each bucketload.

Until recently, walking dragline excavator manufacturers have failed to recognize, or have ignored the effects of torsional stresses on the frame structures of the machines, and the rail girders in particular. According to conventional practice, in order to prevent early failures of the rail girders, it has been the custom to increase the thickness of the steel plates forming the rail girders, and to provide closer spacing for the associated vertical web plates which are secured into a reinforcing grid to and between the deck and base plates of the horizontal frame structures of the machines. This has resulted in smaller cells within the frame structures, a larger number of cells, and has substantially increased the weight and fabrication costs of the frames.

By way of example, reference is made to Sankey U.S. Pat. No. 4,037,894, wherein it is stated that the joints between the lower rail pad and the vertical ribs are subjected principally only to compressive loads and, therefore, the rail pad is unattached to the vertical ribs. This implies that torsional loads and stresses are ignored or may not have been recognized.

In Kalve U.S. Pat. No. 4,329,795, it is recognized that tri-axial stresses, cyclical torsional and twisting forces imposed repeatedly in each operational cycle may eventually cause fatigue failure in the rail girder. The basic object of the disclosure in that patent is to provide efficient load stress relief by providing a separate rail beam which assures relative sliding movement between the rail beam flange and the underlying top plate. This sliding movement produces efficient load stress relief to the rail girder by redistributing some of the stresses to the lesser stressed parts of the frame. It does not add strength to the entire frame or the rail girder.

To a large extent, the present invention is a substantial improvement upon the disclosure in Kalve U.S. Pat. No. 4,611,440, in which it was recognized that the joints in the frame structures are subjected to torsional stresses, whether attached or unattached. Unattached joints are unable to transfer torsional shear stresses at the reentrant corners formed by the vertical webs of the rail beam and the rail pad, causing the vertical web plates and the rail pad member to distort independently of each other with a twisting and warping action under the torsional loading conditions. Without proper jointing, these plates provide only negligible torsional resistance to the frame, but are subjected to high torsional stresses individually.

In said U.S. Pat. No. 4,611,440, there is a showing of double rail beam web plates attached to the upper and lower rail pads, with vertical reinforcing I-shaped bars secured to and between the rail beam web plates at fairly widely spaced points. The purpose of this arrangement is to have both of the rail beam web plates and the rail pad in each instance act as a monolithic structural system. The structure is capable of transferring and distributing unbalanced loads from one web plate to the other web plate. However, a disadvantage has been encountered that in this particular system, due to limited space between the web plates of the rail beam which may only be 10" to 18", welding of the I-shaped bars must be effected from the outside of the rail beam through slots cut in the web plates of the beam. This is a costly and difficult welding process to attain proper securement of the I-shaped bar stiffeners.

SUMMARY OF THE INVENTION

An important object of the present invention is to overcome the disadvantages and difficulties experienced with previous constructions by providing a new and improved tubular web rail girder construction with great torsional and bending resistant strength.

Another object of the present invention is to provide new and improved reinforcement for the rail girders in walking dragline excavators.

A further object of the present invention is to provide new and improved reinforcement in the bottom plate of the base frame structure of these machines for efficient transmission of soil pressure directly to vertical cell plates within the frame structure.

Still another object of the present invention is to provide a new and improved construction wherein the stresses in the welded joints between rail girder and rail pad are substantially reduced.

Yet another object of the present invention is to provide a new and improved frame structure of the kind indicated having efficient horizontal reinforcement.

In accordance with the principles of the present invention, there is provided in a walking dragline excavator including a circular load supporting base frame adapted to lie directly in self-supporting relation on a ground level area, and supporting a load sharing revolving frame connected to the base frame for rotation about an axis concentric with the base frame, each of the frames comprising a massive hollow internally reinforced substantially planar horizontal load sharing frame structure, each of the frame structures comprising a horizontal upper deck plate and a lower horizontal bottom plate, and the plates being substantially spaced apart vertically; each of the frame structures having an outer perimeter and an arrangement of vertical web plates secured in a reinforcing grid to and between the deck and bottom plates; each of the frame structures having a respective vertical annular rail beam secured between the deck plate and the bottom plate of the respective frame structure and located concentrically intermediate the outer perimeter of the frame structure and a central area of the frame structure; the rail beams being in axial, load sharing alignment and having respective edges that are adjacently spaced from one another; opposed respective annular rail structures on the adjacent edges of the rail beams; rotary load transmitting rollers engaged by and between the rail structures; and at least the rail beam of the base frame structure comprising a continuous series of vertical tubular rail beam girders disposed in mutually load sharing side-by-side relation and cooperating in load sharing relation with web plates of the reinforcing grid of the base frame structure.

The present invention also provides a construction of the type indicated wherein certain of the web plates in the frame structure reinforcing grid are oriented in a triangular pattern with apices of the triangles anchored within the base frame structure of the rail beam.

The present invention further provides a construction of the type indicated having bottom plate stiffeners attached to the bottom plate of the base frame structure and also attached to certain of the web plates in the base frame structure reinforcing grid for transmitting soil pressure which acts on this bottom plate directly to these web plates.

There is also provided by the present invention in a construction of the type indicated having base frame rail structure including a rail pad secured to the edge of the rail beam, and reentrant corner torsional shear transfer truss members fixedly secured to the rail pad and to the rail beam and to the contiguous frame structure plate for transferring torsional shear directly from this plate and rail pad into the rail beam for reducing stresses in the joints between the rail beam and the rail pad.

In addition, the present invention provides horizontal stiffeners rigidly secured to and between a rail beam and certain of the base frame structures reinforcing grid web plates of the frame structure.

BRIEF DESCRIPTION OF THE DRAWINGS

Other objects, features and advantages of the present invention will be readily apparent from the following description of representative embodiments thereof, taken in conjunction with the accompanying drawings, although variations and modifications may be effected without departing from the spirit and scope of the novel concepts embodied in the disclosure and in which:

FIG. 4 is a still further enlarged top plan view of a fragmentary portion of the frame structure shown in FIG. 3;

FIG. 5 is a further enlarged fragmental vertical sectional detail view taken substantially along the line V—V in FIG. 4;

FIG. 6 is a substantially enlarged fragmental vertical sectional detail view taken substantially along the line VI—VI in FIG. 4;

FIG. 7 is a fragmentary horizontal sectional detail view taken substantially along the line VII—VII in FIG. 6;

DETAILED DESCRIPTION

Figure 1:
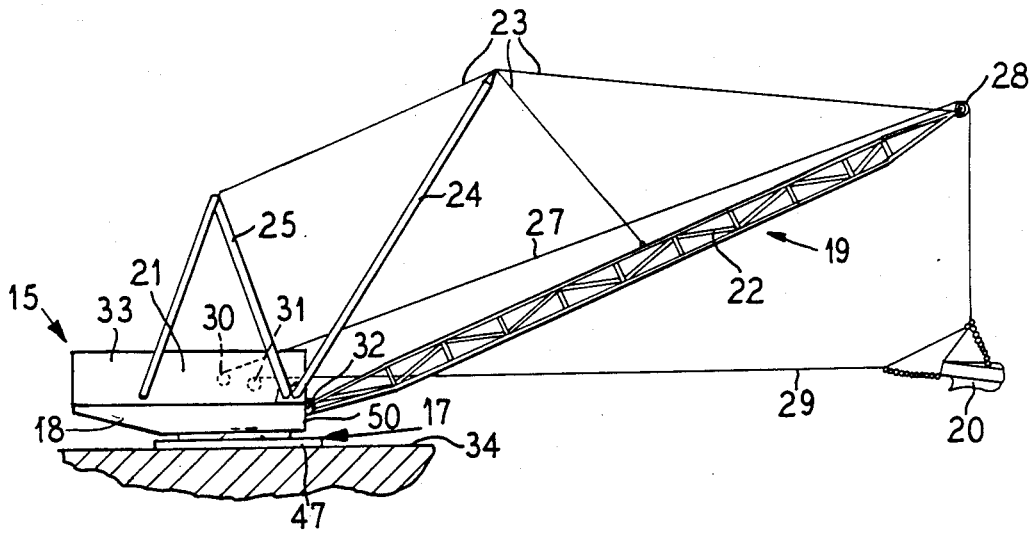
FIG. 1 is a more or less schematic side elevational view of a walking dragline excavator embodying the present invention.
Figure 2:
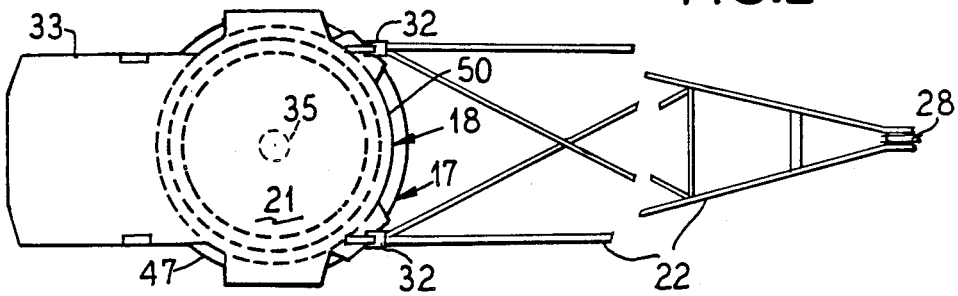
FIG. 2 is an enlarged fragmental top plan view of the excavator of FIG. 1.

A typical walking dragline excavator 15 is schematically illustrated in FIGS. 1 and 2. It includes a generally planar base frame 17 supporting a revolving, counterweighted, generally planar frame 18 carrying a boom structure 19 by which a dragline bucket 20 is operated through appropriate control means activated from the revolving frame. Conventional walking means (not shown) may be provided for raising and moving the excavator 15 when necessary.

A housing 21 on the revolving frame 18 may enclose operating machinery, controls, power source and the like, as is customary with dragline excavators of this type. The boom 19 comprises the usual boom structure 22 controlled by a cable system 23 operated from the control housing 21 and trained over a mast 24 and gantry frame 25. For operating the dragline bucket 20, a hoisting cable or rope 27 is trained over a pulley 28 at the top of the boom 22 and suspends the bucket 20 therefrom. A drag cable or rope 29 is attached to the bucket 20 in usual operating fashion. Operating drums 30 and 31 in and in association with the housing 21 operate the hoisting rope 27 and the drag rope 29, respectively, as controlled by the operator who is suitably accommodated in or in association with the housing 21. As is customary, the boom 22 is pivotally attached for vertical swinging movement to a front end of the revolving frame 18 as by means of pivot knuckles 32. At its rear end, the revolving frame 18 has a platform area 33 on or in which may be carried suitable counterweight means (not shown).

As is usual, the base frame 17 may be of circular form and adapted to lie directly on a ground surface 34. At about its center of weight, the revolving frame 18 is pivotally connected as by means of a center journal or vertical axle 35 (FIGS. 2 and 3) on the vertical axis of the base frame 17 for relative rotary travel of the revolving frame 18 on the base frame 17. Any suitable means may be provided for controlling revolving of the frame 18, such as a customary swing gear 37 mounted on the deck of the base frame 17 and engaged by driven pinion means (not shown) carried by the revolving frame 18 and which provides part of the operating apparatus carried by the revolving frame.

Rotary support of the revolving frame 18 on the base frame 17 is by means of radially inwardly tapered flanged rollers 38 (FIG. 5) in a roller circle centered on the base frame 17 radially outwardly spaced from the swing gear 37. The rollers 38 ride on and between a complementary tapered lower annular rail 39 carried by the lower or base frame 17 and an upper complementary tapered annular rail 40 carried by the revolving frame 18 and aligned in spaced relation to the lower rail 39. As is customary, the rollers 38 are maintained in proper series orientation by means of axle shafts 41 connected to respective radially inner and radially outer cage rings 42 and 43.

Each of the base frame 17 and the revolving frame 18 is of a hollow cellular construction comprising suitable gauge steel plate assemblies all welded together in the frame structures and attaining maximum strength with minimum tonnage of steel in the structures of the frames.

As to the base frame 17, also sometimes referred to as a tub, a hollow interior is defined between a deck plate 44 which throughout at least its major extent is horizontally flat and vertically spaced above an essentially flat horizontal bottom plate 45 which provides the base surface of the base frame to lie directly on a ground surface and is thus subject to soil pressure during operation of the associated walking dragline excavator. A circumferential, vertically extending enclosure wall 47 is secured between the radially outer edge portions of the deck and bottom plates.

To the same effect, the revolving frame 18 has essentially flat horizontal deck plate 48 vertically spaced above a bottom plate 49 which, throughout at least its major extent, is horizontally flat. A circumferential wall 50 encloses the space within the frame 18.

Figure 3:
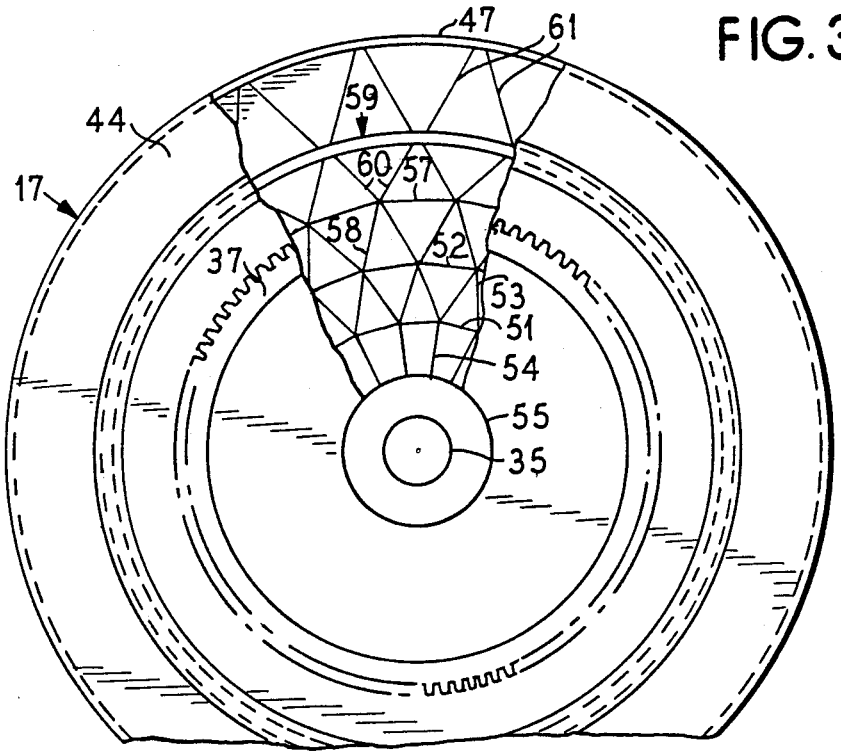
FIG. 3 is a further enlarged top plan view of the base frame of the excavator of FIGS. 1 and 2, and with parts broken away to show details of structure.

Within the base frame 17 and supporting the deck plate 44 on the bottom plate 45 is an arrangement of vertical supporting and reinforcing web plates secured in a cellular reinforcing grid. As best seen in FIG. 3, this grid system of web plates comprises a radially inner annular series of rigidly connected web plates 51 providing an annular girder boundary web surrounded in radially spaced relation by an annular series of connected vertical web plates 52 providing another annular girder boundary web with the junctures of the girder boundary web plates 51 with one another being connected to the junctures of the girder member web plates 52 with one another by rigidly attached, diagonally extending vertical girder web plates 53 disposed in a zig-zag orientation and which, together with the boundary web plates 51 and 52, define triangular cells.

Extending radially inwardly from their junctures with the junctures of the web plates 51 are vertical girder web plates 54 which at their radially inner edges are rigidly joined to an annular vertical girder boundary and hub plate structure 55 within which is accommodated the supporting structure for the vertical axle 35.

Radially outwardly spaced about the annular girder boundary 52 there is provided a third annular girder defined between the girder boundary 52 and a radially outwardly spaced annular girder plate boundary 57. Diagonal vertical grid web plates 58 in a zig-zag arrangement are connected to and between the joints between the plates defining the girder boundaries 52 and 57.

Radially outwardly spaced from the annular girder boundary 57 is an annular rail supporting beam 59, with diagonally, generally triangularly oriented vertical grid web plates 60 rigidly connected to and between the girder boundary 57 and the rail beam 59. Rigidly connecting the rail beam 59 to the enclosure wall 47 is a diagonally extending, generally triangularly arranged annular series of grid web plates 61.

In a new and improved construction, the rail beam 59 comprises a continuous series of vertical tubular rail beam girders 62 (FIGS. 4–7) disposed in a mutually load sharing side-by-side relation and cooperating in load sharing relation with the grid web plates 60 and 61 of the reinforcing grid of the base frame structure 17. In one desirable construction, the rail beam girders 62 comprise hot rolled steel I-beam sections having central webs 63 and spaced lateral flanges 64 extending from the edges of the webs. The vertical edges of the flanges 64 of the contiguous girder beam sections adjoin one another and are welded to one another as by means of welds 65 made from the outer sides of the rail beam 59. To facilitate such welding, a backing bar 67 may be disposed at the inner side of the joint provided by the weld 65, in each instance. Through this arrangement, an exceptionally efficient, highly stress resistant rail beam structure is provided and which is much easier to construct than prior rail beams.

Welded attachment of the grid web plates 60 and 61 is efficiently effected in alignment with the center webs 63 of certain of the girder I-beam sections of the rail girders 62 (FIG. 4). Thereby the aligned apices of the grid web plates 60 and 61 at the rail beam 59 are anchored within the rail beam 59 by means of the webs 63 of the rail girders 62, and the plates 60 and 61 join the rail beam 59 at its most rigid stress resistant locations and efficiently contribute to the load sharing capabilities of the cooperating structures.

At its lower edge, the rail beam 59 is welded to the upper, inner face of the bottom plate 45. At its upper edge, the rail beam 59 is welded to a rail pad 68 which is wider than the rail beam so that the rail pad overhangs the opposite sides of the rail beam. Further, the rail pad 68 is desirably of a thicker plate section than the section of the deck plate 44 into which the pad 68 is set within a complementary annular gap 69 and welded securely to the contiguous edges of the deck plate 44 and to the top edge of the rail beam 59. For convenience, the rail pad 68 is constructed in segments which are welded end-to-end as indicated at 70 (FIG. 4). In each instance, the weld 70 is located in alignment with the juncture welds of the underlying girder beam sections defining one of the tubular girders 62 of the rail beam.

In order to improve the load sustaining cooperation of the rail beam relation of the rail beam 59, the rail pad 68 and the deck plate 44, vertical, generally triangularly shaped torsional shear transfer truss plates 71 (FIGS. 4 and 5) are fixedly secured as by welding to the overhanging portions of the rail pad 68 and the adjacent portions of the rail beam 59 and the underside of the deck plate 44.

As will be noted in FIG. 4, a desirable arrangement of the torsional shear transfer truss plates 71 is two of them located along the inner side of the rail beam 59 in line with certain of the girder webs 63 symmetrically located relative to the triangular cell defined by the adjacent vertical grid web plates 60. A third torsional shear transfer plate 71 is located on the outer side of the rail beam 59 in alignment with the center web 63 of the rail beam girder which is located between the two rail beam girders with which the torsional shear transfer truss plates 71 are aligned at the inner side of the rail beam.

For stiffening junctures of the diagonal grid web plates 60 and 61 with the rail beam 59, vertically spaced, horizontal stiffener plates 72 (FIGS. 4 and 6) are rigidly secured to the sides of the rail beam 59 and the generally convergent margins of the grid plates 60 and 61 at juncture with the rail beam.

Although the description of the various components of the base frame 17 has been set forth in detail, it will be understood that inasmuch as the base frame 17 and the revolving frame 18 are in load sharing cooperation, the internal structure of the revolving frame 18 may be substantially the same as the internal structure as described for the base frame 17. A detailed description of the internal structure of the revolving frame would therefore be substantially repetitious, and has been largely omitted. Especially the rail beam 59' (FIG. 5) of the revolving frame 18 should, in order to attain the utmost advantage from the structure, be the same as the rail beam 59 of the base frame 17. This is indicated in FIG. 5 by common, but primed, reference characters applied to the elements of the revolving frame which are common to the elements of the base frame, and referring in particular to the elements 63', 64' and 71'. It will be observed that the rail pad 68' in the revolving frame 18 is secured in the bottom plate 49 of the revolving frame in similar fashion as the rail pad 68 is secured in the deck plate 44 of the base frame.

Both the base frame rail 39 and the revolving frame rail 40 are secured to the respective rail pads 68 and 68' by means of clips 73.

Figure 8:
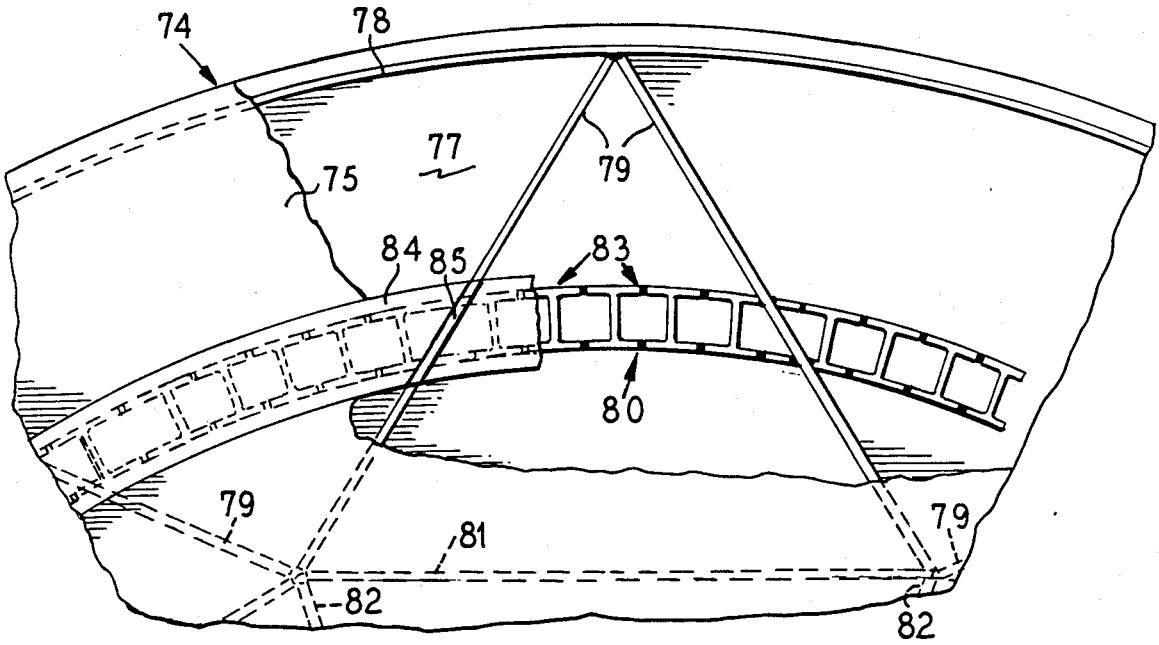
FIG. 8 is a view similar to FIG. 4, but showing a modification.

Another manner of joining vertical web plates in the reinforcing grid of either the base frame or the revolving frame is depicted in FIG. 8. In its basic internal construction, the frame 74 is substantially similar to the frames 17 and 18. Thus, the frame 74 comprises a massive, hollow construction comprising a horizontal plate 75 (which may be either a deck plate or a bottom plate) suitably spaced from a substantially concentric horizontal plate 77 (which may be either a bottom plate or a deck plate), and with a circumferential wall 78 secured to and between the outer margins of the horizontal plates. A reinforcing grid of generally triangularly related vertical web plates is secured to and between the plates 75 and 77 and to the circumferential wall 78 and in this instance, comprising diagonal triangularly related vertical grid web plates 79 which extend continuously from the circumferential wall 78 through a rail beam 80 to inner edges of the adjacent ones of the web grid plates 79 and which have mutual juncture with the junctures of circumferentially oriented vertical web plates 81 joined in a generally circular grid girder web boundary. Where the grid plates 79 extend through the web beam 80, the contiguous components of the rail beam are welded fixedly to the plates 79.

Radially inwardly from the connected plates 81, is a triangular cell configuration of vertical grid plates 82 in generally mirror image relation to and extending from the inner edges of the grid web plates 79. Desirably, the rail beam 80 may be of the same construction as the rail beam 59 already described, and comprises a continuous series of vertical tubular rail girders 83 welded into a mutually load sharing relation and cooperating in load sharing relation with the reinforcing web plate grid through the web plates 79. A rail pad 84 is mounted in the horizontal plate 75 and upon the adjacent edge of the rail beam 80 in substantially the same fashion as described for the rail pads 68, 68'. Segments of the rail pad 84 are desirably secured end-to-end by welds 85 aligned with the portions of the reinforcing grid web plates 79 which extend through and are securely welded to the rail beam 80.

Figure 9:
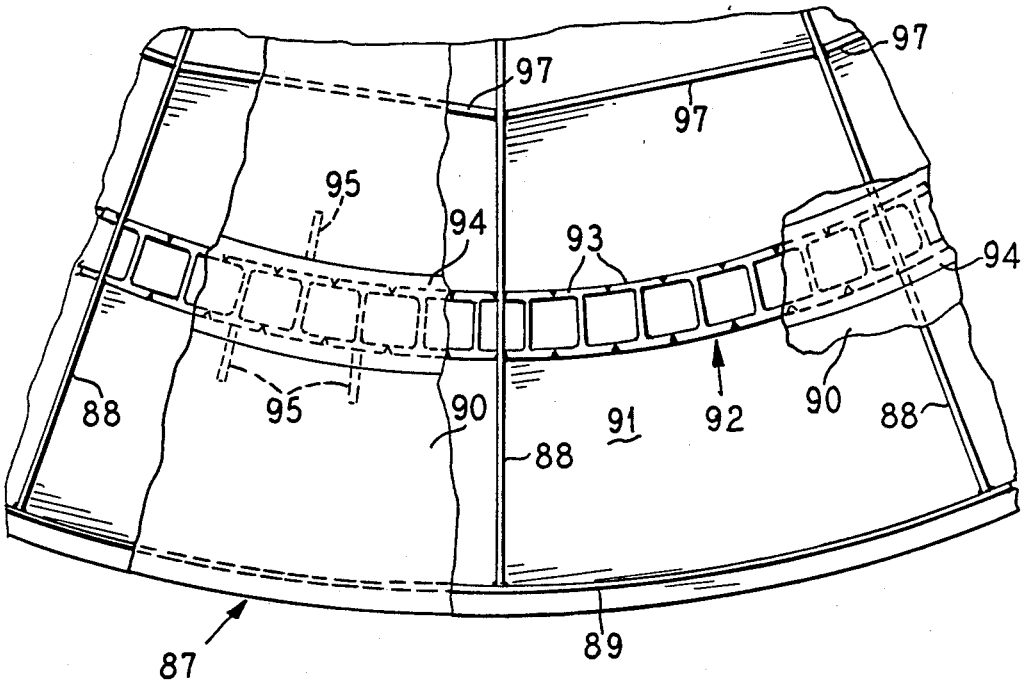
FIG. 9 is a view similar to FIGS. 4 and 8, but showing still another modification.

In FIG. 9, an arrangement is disclosed in which instead of triangular cells, the internal reinforcing grid structure of the horizontal walking dragline excavator frame 87 presents a generally quadrangular cell structure. This cell structure comprises radially extending reinforcing grid vertical web plates 88 which extend from their welded juncture with a circumferential vertical closure wall 89 and are disposed between spaced horizontal deck or bottom plates 90 and 91 in straight radial relation to the hub (not shown) of the frame 87.

Each of the circumferentially uniformly spaced grid plates 88 may extend uninterruptedly through an annular rail beam 92 of substantially the same construction as the rail beams 59 and 80. That is, the rail beam 92 comprises generally I-beam vertical girder members 93 secured as by welding in mutually load sharing relation by having their contiguous edges welded together whereby to provide a uniform pattern of vertical tubular rail girders. Conveniently, the vertical grid web plates 88 may extend between contiguous edges of certain of the girder members 93 which have their contiguous edges welded fixedly to the respective web plates 88. An annular rail pad 94 is similarly, as in the previously described frame structures, fixedly secured in one of the horizontal plates 90 and 91 wherein the horizontal plate 90 and to the contiguous edge of the rail beam 92. As shown, torsional shear transfer truss plates 95, similar to the corresponding plates 71 already described, may be secured fixedly to and between the plate 90, the rail beam 92 and the rail pad 94. Radially inwardly spaced from the rail beam 92, circumferentially aligned girder boundary plates 97 may be secured to and between the horizontal plates 90, 91 and to the contiguous sides of the vertical reinforcing grid plates 88.

Figure 10:
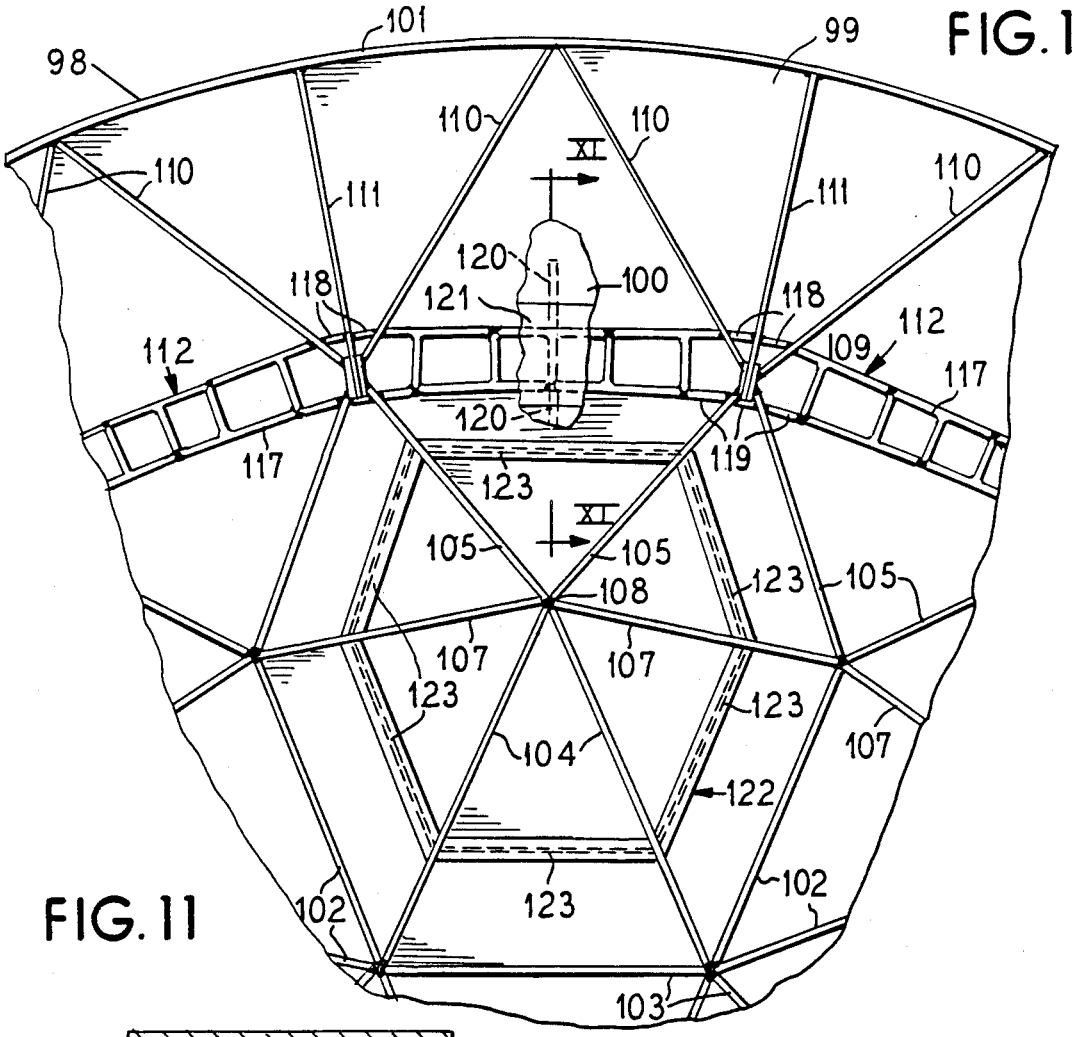
FIG. 10 is a similar top plan view showing yet another modification.
Figure 11:
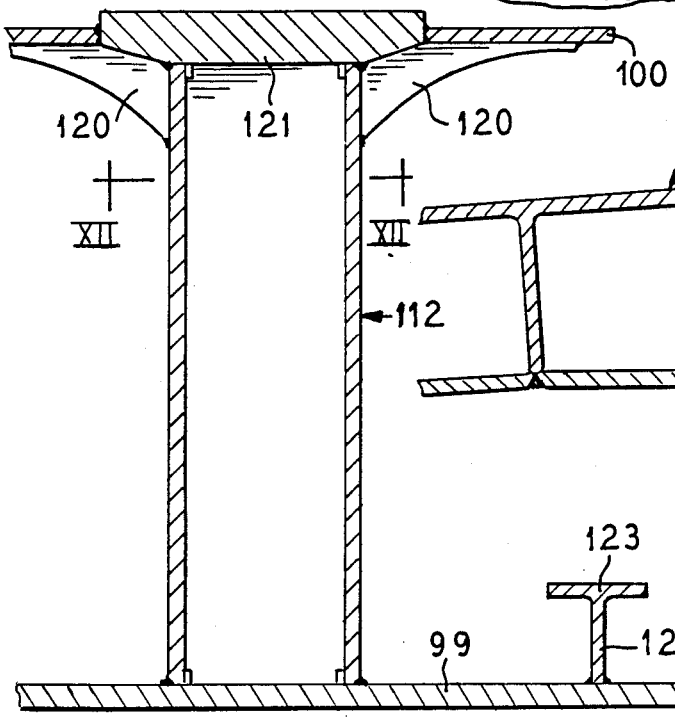
FIG. 11 is a vertical sectional detail view taken substantially along the line XI—XI in FIG. 10.
Figure 12:
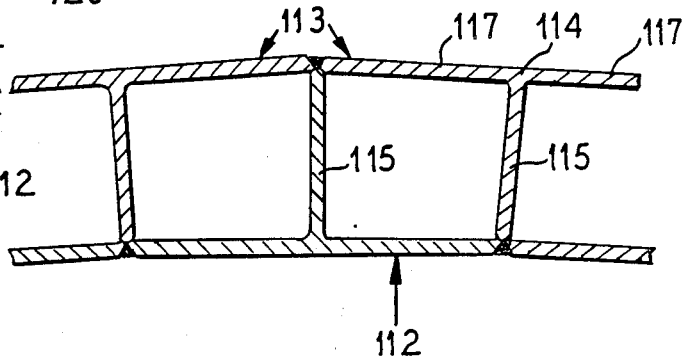
FIG. 12 is a sectional detail view taken substantially along the line XII—XII in FIG. 11.

In the modification shown in FIGS. 10–12, a massive hollow walking dragline frame 98, which for convenience is shown as a base frame but may, to equal effect, comprise a revolving frame, is equipped with spaced horizontal bottom and deck plates 99 and 100, between which is secured a circumferential vertically extending enclosure wall 101. Within the enclosure thus provided, there is a reinforcing grid of generally triangularly related vertical grid plates including generally radially inwardly convergently related plates 102 extending across and welded to an annular vertical radially inner grid girder web plates 103 connected rigidly in end-to-end relation. From the juncture of the vertical plates 102 and 103, generally radially outwardly convergent vertical reinforcing grid web plates 104 join at a vertical joint 108 with vertical radially inwardly convergent vertical grid web plates 105 and with an annular series of girder web boundary plates 107. From the apical juncture 108, the reinforcing grid plates 105 extend diagonally to a common apical weld juncture 109 with diagonal reinforcing vertical grid plates 110 and radially extending plates 111. At their radially outer ends, the plates 110 and 111 are secured fixedly to the circular enclosure web 101. The described arrangement provides an efficient cellular reinforcing grid within the frame 98.

A generally annular rail beam 112 is secured within the reinforcing grid in the frame 98 generally midway between the circular enclosure 101 and the boundary web provided by the plates 107. In this instance, the rail beam 112 comprises a continuous series of vertical tubular rail beam girders 113 comprising a continuous, symmetrical series of generally T-shaped bars 114, each of which comprises a central leg 115 and T-head lateral flanges 117. The rail bars 114 are disposed in alternate assembled relation wherein the edges of the legs 115 are welded to the contiguous edges of the lateral flanges 117 of the contiguous bars 114, as best seen in FIG. 12. Advantageously, the junctures 109 are effected in thoroughly welded integration within the rail beam 112. Thereby, the triangular reinforcement afforded by the juncture of the grid web plates 105, 110 and 111 with one another is tied directly into mutual load sharing relation within the rail beam 112. In effect, each of the weld junctures 109 provides a stiff vertical post within the rail beam 112 which reinforces the otherwise already high load carrying and stress distortion preventing functions of the rail beam into which the convergently related portions of the vertical web plates are welded adjacent to the juncture weld post 109. It may also be noted in FIG. 10 that all of the convergent end portions of the web plates 105, 110 and 111 extend solidly to the juncture 109. In other words, the convergently related portions of the vertical grid web plates extend continuously through the radially inner and radially outer walls of the rail beam 112. Vertical filler web plates 118 provide continuity for the outer wall of the rail beam 112 between the converging portions of the grid plates 110 and 111. For continuity of the inner wall of the rail beam 112 at the converging portions of the grid plates 105, vertical filler web plates 119 are provided.

Torsional shear transfer truss plates 120 are desirably welded into the reentrant angles between the side walls of the rail beam 112 and overhanging side portions of a rail pad 121 and the horizontal plate 110 within which the rail pad 121 is mounted on the adjacent edge of the rail beam.

For reinforcing and stiffening the structure at the horizontal plate 99 and the vertical grid web plates joined at the juncture 108, a set of uniformly circumferentially spaced generally annular stiffeners 122 is provided, only one of which is shown. In a desirable construction, the stiffener 122 comprises a pentagonal arrangement of T-bars 123, which have vertical webs 124 welded to the plate 99, and contiguous ends welded to respectively the vertical web plates between which the bars 123 extend. Thus, one of the stiffener bars 123 extends to and between and is secured to the vertical grid web plates 104. Respective ones of the bars 123 extend to and between and are welded to the web grid plates 104 and 107. Respective ones of the reinforcing bars 123 extend to and between and are welded to the vertical grid web plates 107 and 105. Another of the reinforcing bars 123 extends to and between and is welded to the divergently related bars 105.

It will be understood that all of the parts of the several frame structures are thoroughly welded together unitarily. Wherever it is deemed desirable to provide the same, maintenance openings may be provided through any of the vertical plate structures, as is customary with massive walking dragline excavator frames. The size of the frame structures may be appreciated when it is considered that the base frames may be up to 150 feet in diameter and as much as 8 feet in thickness, made up of steel plate from 1-½" to 3" thick, depending on location of the parts. In the revolving frame, the gantry structure, the dragline boom and bucket, as well as the counterweighting portion of the revolving frame, are proportionately massive structures. In such massive structures, it will be appreciated that the weld joints are subjected to tremendous stress and strain concentrations. The improvements effected by the present invention are designed to alleviate much of the stress and strain and twisting torsional movements in the web plates as well as the rail beams in the frames, thus significantly alleviating serious joint failures which are virtually unreparable in the field because heavy welded joints result in high residual stresses and costly heat treatment is required to relieve those residual stresses. Proper maintentance repairs of welded joints in these frame structures is not feasible because the stress relieving by heat treatment in a closed frame is virtually precluded. Serious failure of the welded joints usually requires replacement of the entire frame, which is a very costly event, and which it is the aim of the present invention to alleviate.

An important advantage in addition to stress and strain relief resulting from the present invention is the fact that the cell structures of the internal reinforcement of the frames can be more open with larger cells, and those parts which heretofore were most subject to stress and strain can be made with lighter gauge material because of the unique load sharing, stress relieving relationships in those structures, and especially the rail beam structure, which are most subject to bending and torsional stresses in service of the dragline excavator.

It will be understood that variations and modifications may be effected without departing from the spirit and scope of the novel concepts of the present invention.

I claim:

1. In a walking dragline excavator including a circular load supporting base frame adapted to lie directly in self-supporting relation on a ground level area, and supporting a load sharing revolving frame connected to the base frame for rotation about an axis concentric with the base frame, each of said frames comprising a massive hollow internally reinforced substantially planar horizontal frame structure:

each of said frame structures comprising a horizontal upper deck plate and a lower horizontal bottom plate, and said plates being spaced apart vertically;

each of said frame structures having an outer perimeter and an arrangement of vertical web plates secured in a reinforcing grid to and between said deck and bottom plates;

each of said frame structures having a respective vertical annular rail beam secured between the deck plate and the bottom plate of the respective frame structure and located concentrically intermediate the outer perimeter of the frame structure and a central area of the frame structure;

said rail beams being in axial, load sharing alignment and having respective edges that are adjacently spaced from one another;

opposed respective annular rail structures on said adjacent edges of said rail beams;

rotary load transmitting rollers engaged by and between said rail structures;

at least the rail beam of said base frame structure comprising a continuous series of vertical tubular rail beam girders disposed in mutually load sharing side-by-side relation and cooperating in load sharing relation with web plates of said reinforcing grid of said base frame structure;

certain of said web plates in said base frame structure reinforcing grid being oriented in a triangular pattern with apices of the triangles anchored within said base frame structure rail beam;

bottom plate stiffeners attached to said bottom plate of the base frame structure and also attached to certain of the web plates in said base frame structure reinforcing grid for transmitting soil pressure acting on this bottom plate directly to these web plates;

said base frame rail structure including a rail pad secured to the top edge of said base frame structure rail beam, and reentrant corner torsional shear transfer truss members fixedly secured to said rail pad and to said base frame rail beam and to said base frame structure deck plate for transferring torsional shear directly from this top plate and rail pad into said base frame rail beam for reducing stresses in the joints between this rail beam and rail pad and deck plate; and horizontal stiffeners rigidly secured to and between said base frame structure rail beam and certain of said base frame structure reinforcing grid web plates.

2. A walking dragline excavator according to claim 1, wherein said revolving frame structure also has a rail beam comprising a continuous series of vertical tubular rail beam girders disposed in mutually load sharing side-by-side relation and cooperating in load sharing relation with web plates of the reinforcing grid of said revolving frame structure.

3. A walking dragline excavator according to claim 1, wherein said revolving frame rail structure includes a rail pad secured to the bottom edge of said revolving frame structure rail beam, and reentrant corner torsional shear transfer truss members fixedly secured to said rail pad and to said revolving frame rail beam and to said revolving frame structure bottom plate for transferring torsional shear directly from this bottom plate and rail pad into said revolving frame rail beam for reducing stresses in the joints between this rail beam and rail pad and deck plate.

4. In a walking dragline excavator circular load supporting base frame adapted to lie directly in self-supporting relation on a ground level area, and a load sharing revolving frame connected to the base frame for rotation about an axis concentric with the base frame, each of said frames comprising a massive hollow internally reinforced substantially planar horizontal load sharing frame structure:

each of said frame structures comprising a horizontal upper deck plate and a lower horizontal bottom plate, and said plates being spaced apart vertically;

each of said frame structures having an outer perimeter and an arrangement of vertical web plates secured in a reinforcing grid to and between said deck and bottom plates;

each of said frame structures having a respective vertical annular rail beam secured between the deck plate and the bottom plate of the respective frame structure and located concentrically intermediate the outer perimeter of the frame structure and a central area of the frame structure;

said rail beams being in axial, load sharing alignment and having respective edges that are adjacently spaced from one another;

opposed respective annular rail structures on said adjacent edges of said rail beams;

rotary load transmitting rollers engaged by and between said rail structures; and at least one of said rail beams comprising a continuous series of vertical tubular rail girder memebers disposed in mutually load sharing relation and cooperating in load sharing relation with said reinforcing grid of the associated frame structure.

5. The structure of claim 4, wherein said at least one rail beam is located within said base frame structure and has the associated annular rail structure on its upper edge.

6. A structure as defined in claim 4, wherein said at least one rail beam is within the revolving frame structure, and the associated annular rail structure is on the bottom end of said rail beam.

7. A structure as defined in claim 4, wherein certain of the web plates in the frame structure reinforcing grid are oriented in a triangular pattern with apices of the triangles anchored within said one rail beam.

8. A structure as defined in claim 4, wherein said at least one rail beam is within said base frame structure, and bottom plate stiffeners attached to said bottom plate of the base frame structure and also attached to certain of the web plates in said base frame structure reinforcing grid for transmitting soil pressure directly to these web grid plates.

9. A structure as defined in claim 4, wherein said rail structure associated with said at least one rail beam includes a rail pad secured to the edge of said one rail beam, and reentrant corner torsional shear transfer truss members fixedly secured to said rail pad and to said one rail beam and to the associated horizontal plate aligned with said one end of said one rail beam for transferring torsional shear directly from said aligned plate and rail pad into said one rail beam for reducing stresses in the joints between this rail beam and rail pad and aligned horizontal plate.

10. A structure according to claim 4, wherein horizontal stiffeners are rigidly secured to and between said one rail beam and certain of the associated frame structure reinforcing grid web plates.

11. In a walking dragline excavator circular load supporting base frame adapted to lie directly in self-supporting relation on a ground level area, and a load sharing revolving frame connected to the base frame for rotation about an axis concentric with the base frame, each of said frames comprising a massive hollow internally reinforced substantially planar horizontal load sharing frame structure:

each of said frame structures comprising a horizontal upper deck plate and a lower horizontal bottom plate, and said plates being spaced apart vertically;

each of said frame structures having an outer perimeter and an arrangement of vertical web plates secured in a reinforcing grid to and between said deck and bottom plates;

each of said frame structures having a respective vertical annular rail beam secured between the deck plate and the bottom plate of the respective frame structure and located concentrically intermediate the outer perimeter of the frame structure and a central area of the frame structure;

said rail beams being in axial, load sharing alignment and having respective edges that are adjacently spaced from one another;

opposed respective annular rail structures on said adjacent edges of said rail beams;

rotary load transmitting rollers engaged by and between said rail structures; and certain of said web plates in at least one of said frame structure reinforcing grid being oriented in a triangular pattern with apices of the triangles anchored within the rail beam of said at least one frame structure.

12. A structure according to claim 11, wherein the rail beam of said at least one frame structure comprises a continuous series of vertical tubular rail beam girders disposed in mutually load sharing side-by-side relation and cooperating in load sharing relation with web plates of said reinforcing grid of said one frame structure.

13. A structure according to claim 11, wherein said one frame structure comprises the base frame, and bottom plate stiffeners attached to the bottom plate of said base frame structure and also attached to certain of the web plates in said base frame structure reinforcing grid for transmitting soil pressure acting on this bottom plate directly to these web plates.

14. A structure according to claim 11, wherein the rail structure of said one frame structure includes a rail pad secured to an edge of said one frame structure rail beam, and reentrant corner torsional shear transfer truss members fixedly secured to said rail pad and to said one frame structure rail beam and to the adjacent horizontal plate for transferring torsional shear directly from this plate and the rail pad into said one frame structure rail beam for reducing stresses in the joints between this rail beam and rail pad and horizontal plate.

15. A structure according to claim 11, including horizontal stiffeners rigidly secured to and between the rail beam of said one frame structure and certain of the reinforcing grid web plates of said one frame structure.

16. In a walking dragline excavator circular load supporting base frame adapted to lie directly in self-supporting relation on a ground level area, and a load sharing revolving frame connected to the base frame for rotation about an axis concentric with the base frame, each of said frames comprising a massive hollow internally reinforced substantially planar horizontal load sharing frame structure:

each of said frame structures comprising a horizontal upper deck plate and a lower horizontal bottom plate, and said plates being spaced apart vertically;

each of said frame structures having an outer perimeter and an arrangement of vertical web plates secured in a reinforcing grid to and between said deck and bottom plates;

each of said frame structures having a respective vertical annular rail beam secured between the deck plate and the bottom plate of the respective frame structure and located concentrically intermediate the outer perimeter of the frame structure and a central area of the frame structure;

said rail beams being in axial, load sharing alignment and having respective edges that are adjacently spaced from one another;

opposed respective annular rail structures on said adjacent edges of said rail beams;

rotary load transmitting rollers engaged by and between said rail structures;

bottom plate stiffeners attached to said bottom plate of said base frame structure and also attached to certain of the web plates in said base frame structure reinforcing grid for transmitting soil pressure directly to these web plates; and said rail beam of said base frame structure comprising a continuous series of vertical tubular rail beam girders disposed in mutually load sharing side-by-side relation and cooperating in load sharing relation with web plates of the reinforcing grid within said base frame structure, said beam girders having generally radially extending webs and integral circumferentially extending flanges fixedly welded to one another and to said upper and bottom plates and to said reinforcing grid.

17. A structure according to claim 16, wherein certain of said web plates in said base frame structure reinforcing grid are oriented in a triangular pattern with apices of the triangles defined thereby anchored within said base frame structure rail beam.

18. A structure according to claim 16, wherein at least one of the rail structures includes a rail pad secured to the edge of the associated rail beam, and reentrant corner torsional shear transfer truss members fixedly secured to said rail pad and to the associated rail beam and to the associated horizontal plate of said one frame structure for transferring torsional shear directly from this horizontal plate and rail pad into said associated rail beam for reducing stresses in the joints between this rail beam and rail pad and deck plate.

19. A structure according to claim 16, including horizontal stiffeners rigidly secured to and between the rail beam of the base frame structure and certain of said base frame structure reinforcing grid web plates.

20. In a walking dragline excavator circular load supporting base frame adapted to lie directly in self-supporting relation on a ground level area, and a load sharing revolving frame connected to the base frame for rotation about an axis concentric with the base frame, each of said frames comprising a massive hollow internally reinforced substantially planar horizontal load sharing frame structure:

each of said frame structures comprising a horizontal upper deck plate and a lower horizontal bottom plate, and said plates being spaced apart vertically;

each of said frame structures having an outer perimeter and an arrangement of vertical web plates secured in a reinforcing grid to and between said deck and bottom plates;

each of said frame structures having a respective vertical annular rail beam secured between the deck plate and the bottom plate of the respective frame structure and located concentrically intermediate the outer perimeter of the frame structure and a central area of the frame structure;

said rail beams being in axial, load sharing alignment and having respective edges that are adjacently spaced from one another;

opposed respective annular rail structures on said adjacent edges of said rail beams;

rotary load transmitting rollers engaged by and between said rail structures; and the rail structures of said frame structures each including a rail pad secured to the edge thereof which confronts the other of the rail structures, and reentrant corner torsional shear transfer truss members fixedly secured to the rail pads and to the associated rail beams and to the associated horizontal plates for transferring torsional shear directly from such horizontal plates and rail pads into the associated rail beams for reducing stresses in the joints between the rail beams and the rail pads and the associated horizontal plates.

21. A structure according to claim 20, wherein said rail beams comprise a continuous series of vertical tubular rail beam girders disposed in mutually load sharing side-by-side relation and cooperating in load sharing relation with web plates of said reinforcing grid of the associated frame structure.

22. A structure according to claim 20, wherein certain of said web plates in said reinforcing grids of said frame structures are oriented in a triangular pattern with apices of the triangles anchored within the respective rail beams.

23. A structure according to claim 20, wherein said base frame structure has a bottom plate, and bottom plate stiffeners attached to its bottom plate and also attached to certain of the web plates in said base frame structure reinforcing grid for transmitting soil pressure on this bottom plate directly to these web plates.

24. A structure according to claim 20, including horizontal stiffeners rigidly secured to and between at least the base frame structure rail beam and certain of the base frame structure reinforcing grid web plates.

25. In a walking dragline excavator circular load supporting base frame adapted to lie directly in self-supporting relation on a ground level area, and a load sharing revolving frame connected to the base frame for rotation about an axis concentric with the base frame, each of said frames comprising a massive hollow internally reinforced substantially planar horizontal load sharing frame structure:

each of said frame structures comprising a horizontal upper deck plate and a lower horizontal bottom plate, and said plates being spaced apart vertically;

each of said frame structures having an outer perimeter and an arrangement of vertical web plates secured in a reinforcing grid to and between said deck and bottom plates;

each of said frame structures having a respective vertical annular rail beam secured between the deck plate and the bottom plate of the respective frame structure and located concentrically intermediate the outer perimeter of the frame structure and a central area of the frame structure;

said rail beams being in axial, load sharing alignment and having respective edges that are adjacently spaced from one another;

opposed respective annular rail structures on said adjacent edges of said rail beams;

rotary load transmitting rollers engaged by and between said rail structures; and horizontal stiffeners rigidly secured to and between the base frame structure rail beam and certain of said base frame structure reinforcing grid web plates.

26. A structure according to claim 25, wherein the rail beams of said frame structures comprise a continuous series of vertical tubular rail beam girders disposed in mutually load sharing side-by-side relation and cooperating in load sharing relation with web plates of said reinforcing grids of said frame structures.

27. A structure according to claim 25, wherein certain of said web plates in at least said base frame structure reinforcing grid are oriented in a triangular pattern with apices of the triangles anchored within said frame structure rail beam.

28. A structure according to claim 25, wherein the bottom plate of said base frame has rigidly secured thereto stiffeners which are also rigidly attached to certain of the web plates in said base frame structure reinforcing grid for transmitting soil pressure acting on this bottom plate directly to these web plates.

29. A structure according to claim 25, wherein said stiffeners are arranged in a pentagonal relation, and with the web plates to which attached converging at and secured in a joint within the pentagonal arrangement.

30. A structure according to claim 25, wherein said rail structures each includes a rail pad secured to the edge of the associated rail beam, and reentrant corner torsional shear transfer truss members fixedly secured to the rail pad and to the rail beam and to the horizontal plate associated with the rail pad for transferring torsional shear directly from such plate and rail pad into the rail beam for reducing stresses in the joints between the rail beam and rail pad and horizontal plate.

* * * * *